United States Patent [19]

Johnson

[11] 4,059,033

[45] Nov. 22, 1977

[54] OIL CAP REMOVER

[76] Inventor: Dennis G. Johnson, 6930 San Francisco St., Highland, Calif. 92346

[21] Appl. No.: 679,726

[22] Filed: Apr. 23, 1976

[51] Int. Cl.[2] ..... B67B 7/18; B25B 13/48

[52] U.S. Cl. ..... 81/3.1 B; 81/90 C; 81/125

[58] Field of Search ..... 81/3.1 R, 3.1 B, 3.34, 81/3.4, 90 R, 90 C, 90 B, 125

[56] References Cited

U.S. PATENT DOCUMENTS

| | | | |
|---|---|---|---|
| 2,694,603 | 11/1954 | Griffin | 81/90 C |
| 3,274,864 | 9/1966 | Chapman | 81/90 B |
| D. 238,926 | 2/1976 | Wall | 81/90 C |

*Primary Examiner*—James L. Jones, Jr.
*Assistant Examiner*—Roscoe V. Parker
*Attorney, Agent, or Firm*—Dana E. Keech

[57] ABSTRACT

A twelve inch straight rod manually actuated by a cross bar handle fixed to one end thereof, the opposite end of said rod having mounted thereon a device for engaging and hooking onto a certain type of oil cap widely used by American automobile manufacturers, and for unscrewing, removing and then replacing said cap without having to touch the cap with the hands, said device then being readily detachable from the cap.

2 Claims, 4 Drawing Figures

OIL CAP REMOVER

SUMMARY OF THE INVENTION

The oil cap, aforesaid, is applied directly to an automobile engine and therefore reaches temperatures in excess of 200° F in normal highway use of the automobile equipped therewith. To add oil to the engine requires unscrewing and removing said cap and subsequently replacing the same. It is general practice to use a rag or gloves to protect the hands from burning when adding oil to the engine, either by the hot oil cap or by hot liquid circulation hoses closely overlying said cap.

It is a prime object of the present invention to provide an inexpensive tool, readily storable in any automobile or added to automobile service station equipment for the convenience of attendants, which will eliminate the hazard of burning the hands when adding oil to an automobile engine.

Another object is to provide such a device embodying hook means for engaging the two hollow ears of the oil cap for applying torque in unscrewing and screwing said cap and spring biased means for retaining said hook means in interlocking engagement with the cap until deliberately disengaged by a prescribed manipulation of the device for releasing said cap.

DETAILED DESCRIPTION OF THE PREFERRED EMBODIMENT

Figure 1:
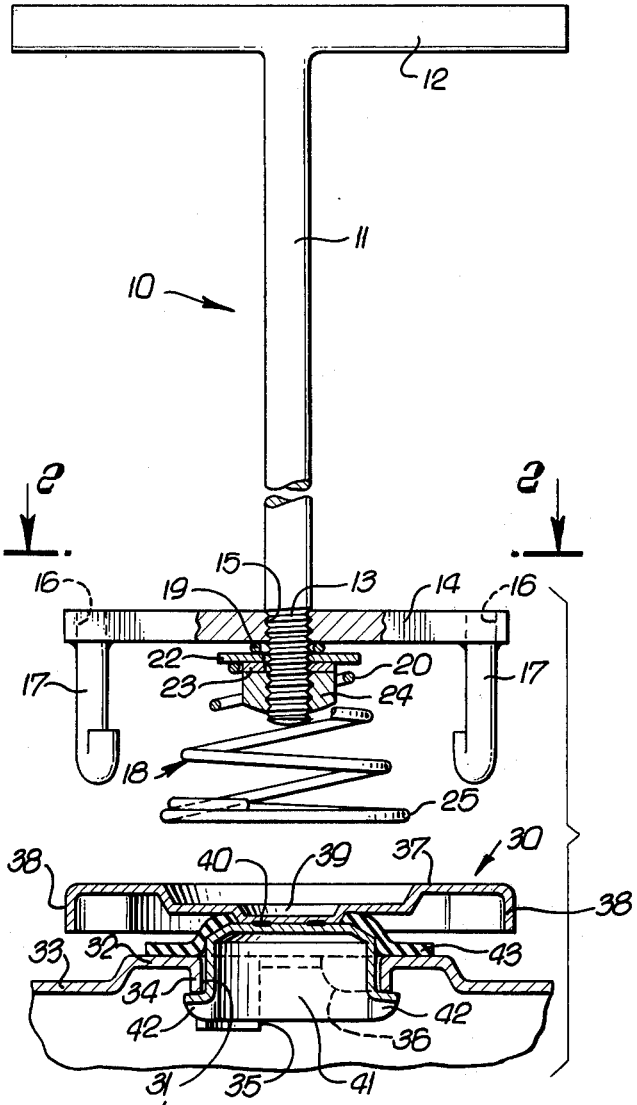
FIG. 1 is a front elevational view, partly broken away, and partly in section of a preferred embodiment of the invention juxtaposed above an oil cap, the latter shown closed and in section, to illustrate the relationship between the invention and said cap immediately preceding application of the invention to the cap for the purpose of unscrewing and removing said cap.

The tool 10 of the invention preferably includes a foot long steel rod 11 having a handle 12 welded onto its upper end and provided with threads 13 at its lower end.

A hook supporting cross head 14 is formed of steel 3/16 inch × ½ inch bar stock 3 inches long centrally bored and tapped at 15 to screw onto threads 13 and provided near its extremities with a pair of 3/16 inch vertical holes 16. A pair of "J" shaped hooks 17 are driven upward into holes 16 and brazed or welded in place with these hooks trailing approximately counter clockwise with reference to rod 11.

A conically coiled light steel wire spring 18 has its initial turn 19 snugly fitting around the tapped downward extending portion of rod 11. The next turn 20 of spring 18 extends downwardly through a split 21 of a spring washer 22 encircling rod 11 (see FIG. 2). A smaller washer 23 fits over rod 11 and the spring 18 and washers 22 and 23 are rigidly locked together with rod 11 and crosshead 14 by a nut 24.

The axial length of spring 18 is about 1¼ inches. The lowermost turn 25 of the spring lies in a horizontal plane and has a diameter of about 1¾ inches.

Referring particularly to FIG. 1, a cap 30 is here shown which is typical of the oil caps the invention is designed to handle. This cap covers a hole 31 formed centrally in a horizontal flat seat 32 embodied with the housing 33 of the lubricating oil receptacle of the engine of an automobile.

The hole 31 has a metal apron 34 extending downwardly from the seat 32 in which apron are formed two diametrically opposed vertical slots 35. The apron 34 is also cut away at 36 in a clockwise direction from each slot 35 for a purpose to be made clear later.

The cap 30 includes a light hollow sheet steel stamping 37 which is cylindrical excepting for two hollow diametrical ears 38 formed integrally therewith. A central depressed portion 39 of cap 30 is united co-axially as by spot welding 40 with a similar central portion of an inverted hollow plug 41 which loosely fits the apron 34 and has diametrally outstruck hollow dogs 42 which hold cap 30 closed when positioned as shown in FIG. 1, but allows it to open when rotated 90° counter clockwise, so as to bring dogs 42 into vertical apron slots 35.

Finally, cap 30 is provided with an annular, fairly turgid rubber like seal 43 which is held in snug sealing relation with seat 32 when the cap is closed as in FIG. 1 by the dogs 42 being cammed downward into the diametrically cutaway portions 36 of the apron 34.

It is thus seen that cap 30 may be readily unscrewed and removed by engaging the ears 38 and turning the cap counter clockwise. To replace the cap in a position for sealing closed the oil receiving hole 31, the dogs 42 must first be in alignment with apron slots 35 allowing the cap to be depressed without rotation until dogs 42 are opposite cutaway apron portions 36, whereupon the cap is ready for 90° clockwise roation which cams seal 43 firmly closed.

OPERATION

Figure 2:
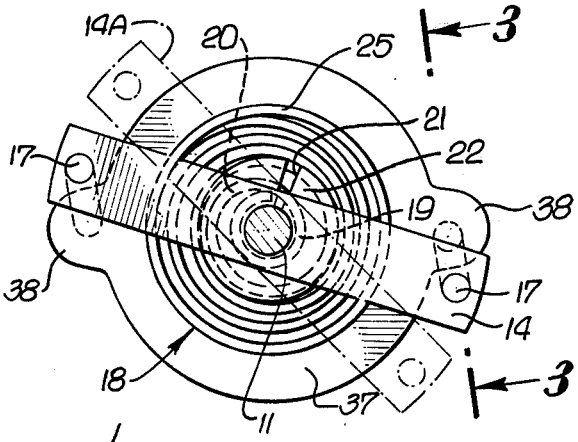
FIG. 2 is a horizontal sectional view taken on the line 2—2 of FIG. 1 and shows in broken lines the hook mounting cross head of the device positioned as lowered pressurally onto the cap, and in full lines the position reached by said cross head in which it interlocks with the diametrically opposed hollow ears of said cap.

To employ the tool 10 in unscrewing and removing the cap 30 the tool is aligned with the cap as shown in FIG. 1 and rotated to position the crosshead 14 as shown by broken lines 14A in FIG. 2. The tool is then lowered to compress spring 18 against the cap 30 until the "J" hooks 17 are below the level of the cap stamping 37. The tool 10 is thereupon rotated counter clockwise to the full line position shown in FIG. 2 in which hooks 17 extend beneath the ears 38 of the cap and engage said ears to cooperate with the friction between the spring and the cap to impart a quarter counter clockwise turn to the cap which unlocks the same by aligning cap locking dogs 42 with apron slots 35. The rotation of cap 30 is halted in this position by dogs 42 engaging the vertical left edges of slots 35.

Figure 3:
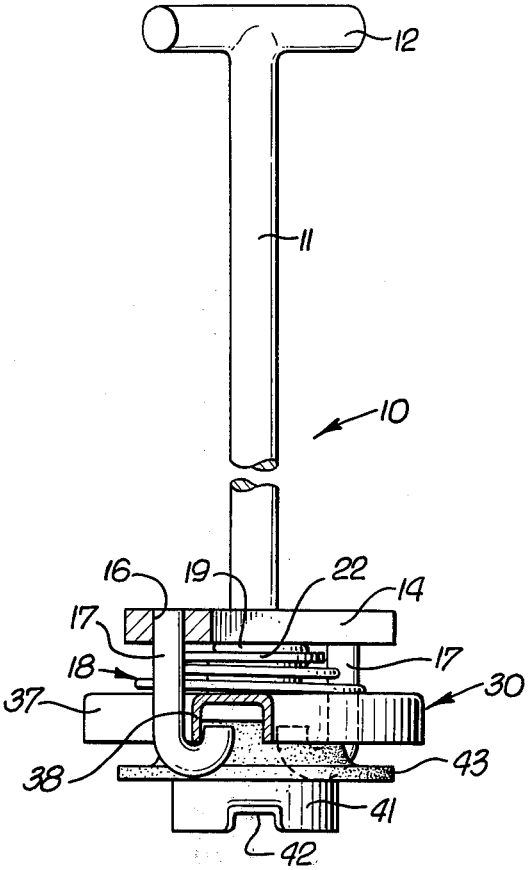
FIG. 3 is a detail vertical sectional view taken on the line 3—3 of FIG. 2 and illustrates the interlocking of a pair of "J" shaped hooks respectively with the aforesaid hollow cap ears.
Figure 4:
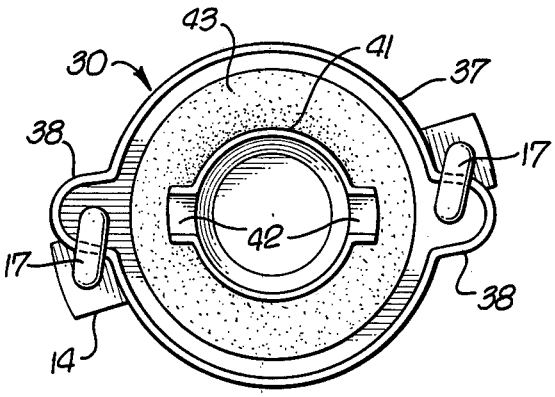
FIG. 4 is a bottom plan view of FIG. 2 illustrating further the spring biased capturing of said oil cap by the tool of the invention.

When this occurs, downward pressure on the tool 10 is relaxed causing spring 18 to expand raising hooks 17 into interlocking relation with the ears 38 and capturing the cap in a spring biased grip as shown in full lines in FIGS. 2, 3 and 4.

By lifting tool 10, the cap 30 is thus removed from the oil hole 31 and remains captured by the tool when the latter is laid down while adding oil to the engine. This done, the tool 10 is picked up and lowered in co-axial relation with hole 31 and with dogs 42 aligned with slots 35 until the sealing annulus 43 comes to rest on the seat 32 surrounding the oil hole 31.

Taking care not to depress the tool, and thus assure that the hooks 17 remain in interlocking engagement with the cap ears 38, the tool is now rotated 90° in a clockwise direction thus camming dogs 42 underneath the cutaway portions 36 of the oil hole apron 34 thereby locking said cap closed and halting its clockwise rotation.

When the closing of cap 30 is thus concluded, the tool 10 is immediately disengaged from the cap by pushing down thereon to lower the hooks 17 below the level of the stamping 37 of the cap and then turning the tool clockwise at least to the broken line position 14A shown in FIG. 2 and then relaxing downward pressure on the tool thereby allowing expansion of the spring 18 to free the tool from engagement with the cap, as shown in FIG. 1.

I claim:

1. In a tool for removing screw oil cap from an automobile engine, said cap having a pair of diametrally opposed downwardly hollowed peripherally protruding ears, the combination of:

a rod having a handle at one end;

a crosshead fixed at its center to the opposite end of said rod;

a pair of "J" shaped hooks extending downwardly from opposite ends of said crosshead, said hooks trailing from their connections with said crosshead approximately in a counter clockwise relation with said rod and turning up sharply at their lower ends; and spring means mounted on said tool between said hooks for compression between said cap and said tool when the tool is co-axially lowered compressively onto said cap with said hooks respectively closely facing said hollow ears, to thereby lower said hooks below the level of said ears, and facilitate counterclockwise rotation of said tool to bring said hooks under said ears, and when the pressure applied on said tool is relaxed, to upwardly spring bias said hooks with said tool to interlock said hooks with said ears, said tool thus capturing said cap, thereby permitting the cap to be unscrewed and removed and then screwed back in place by torque transmitted from said handle through said hooks to said ears optionally in clockwise or counter-clockwise directions and without disturbing the captive relation between said hooks and said cap until the cap has been replaced and it is deliberately released from said hooks by depressing the tool to shift said hooks entirely below the lower level of said ears and then rotating the tool clockwise to shift said hooks out from under said ears.

2. A combination as recited in claim 1 wherein the lower end of said rod is threaded, and said crosshead is centrally bored and tapped and screwed onto said threaded lower end of said rod so that the threaded lower extremity of said rod extends downwardly through said crossbar, and wherein said spring means comprises a conoidal shaped coiled wire spring, the smallest turn of which is wound snugly about said threaded downward extending extremity of said rod;

a split washer surrounding said rod over said smallest spring turn, the next larger spring turn extending through the split in said washer;

a plain washer surrounding said rod and overlying said split washer; and a nut screwed onto the threaded lower end of said rod to firmly secure said spring to said crosshead.

* * * * *